US005564599A

United States Patent [19]

Barber et al.

[11] Patent Number: 5,564,599

[45] Date of Patent: Oct. 15, 1996

[54] FOLDABLE SHIPPING CONTAINER

[75] Inventors: George L. Barber, Twinsburg; Curtis P. Taylor, Chargin Falls, both of Ohio

[73] Assignee: Hoover Group, Inc., Alpharetta, Ga.

[21] Appl. No.: 404,328

[22] Filed: Mar. 15, 1995

[51] Int. Cl.[6] ..... B65D 35/56

[52] U.S. Cl. ..... 222/105; 222/185.1; 206/800; 220/6

[58] Field of Search ..... 222/92, 105, 183, 222/143, 185.1; 206/386, 600; 220/666, 6, 4.28, 4.29, 4.32

[56] References Cited

U.S. PATENT DOCUMENTS

| | | | |
|---|---|---|---|
| 4,793,507 | 12/1988 | Delplanque | 206/600 |
| 4,947,988 | 8/1990 | Schutz | 222/105 |
| 5,002,194 | 3/1991 | Nichols | 206/386 |
| 5,269,414 | 12/1993 | D'Hollander | 206/600 |
| 5,361,923 | 11/1994 | Knight, IV et al. | 220/666 |
| 5,375,741 | 12/1994 | Harris | 222/105 |
| 5,419,448 | 5/1995 | Watson | 220/6 |

*Primary Examiner*—Andres Kashnikow
*Assistant Examiner*—Philippe Derakshani
*Attorney, Agent, or Firm*—Harness, Dickey & Pierce, P.L.C.

[57] ABSTRACT

A foldable shipping container capable of being shipped in either a folded or erected condition. The container includes an outer container and an inner tank. The outer container is foldable upon itself so that all portions of the outer container are generally confined within the perimeter of the its base. The inner tank is also provided with a protected valve assembly located within the perimeter of the base and further includes an inflatable support which assists in the filling the inner tank.

32 Claims, 4 Drawing Sheets

FOLDABLE SHIPPING CONTAINER

BACKGROUND OF THE INVENTION

1. Field of the Invention

The present invention generally relates to foldable shipping containers and, more particularly, to an intermediate bulk container (IBC) in which the outer container or shell is foldable and reusable. Containers according to the principles of the present invention are particularly suitable for the transportation, storage and handling of flowable materials, such as liquids and flowable powders, and generally have a capacity of at least two hundred and seventy-five (275) gallons.

2. Description of the Prior Art

Numerous industries require the transportation and storage of bulk flowable materials (hereinafter liquids). While a variety of containers are presently used, one of the most common continues to be the conventional fifty-five (55) gallon drum. The disadvantages of these cylindrical drums have been well documented and include, without limitation, the following: an inefficient use of storage space, an inefficient use of transportation space, difficult handling, difficult content discharge, and inconvenient reuse and disposal of empty drums.

Because of the inefficiency in returning the empty drums, the drums themselves are generally regarded as disposable items which, in the past, have been largely discarded. Aside from the obvious volume of landfill space uselessly occupied by such drums, this also gives rise to environmental concerns which result from the residual materials located in the drums migrating into the leachate of the landfill.

Reusing the drums has its own set of problems. In particular, the necessary complete emptying and cleaning of the drums requires expensive machinery. Transporting the empty drums back to the liquid supplier further constitutes an extremely inefficient use of transportation space because of the large "empty" volume being transported.

More recently, the fifty-five gallon drum has been replaced by larger quantity, cubic shaped shipping containers. These containers not only provide for enhanced stacking and handling, but also provide benefits with respect to disposal, reusability and conservation of shipping space. Unlike cylindrical drums, cubic containers are capable of occupying substantially all of the space within the shipping vehicle.

One variety of cubic shipping container includes a box-like outer jacket or shell in which is contained a blow molded, polyethylene inner tank. Since the shell never directly contacts the liquids being transported, contamination of the outer shell is not a concern and the inner tank is easily removed before recycling or reuse of the outer shell. The used inner tank itself can either be disposed of or recycled.

In an attempt to improve upon the reusable IBC, containers have recently appeared in which the outer shell is foldable into a collapsed state. This allows the container to be shipped from the container manufacturer to the liquid supplier in a reduced size configuration which permits an increased number of containers to be shipped in the same or decreased amount of space. At the liquid supplier's facilities, the shell is unfolded or erected, the inner tank is filled, and the container shipped to the end user. Once the contents have been emptied from the container, the outer shell can again be folded and sent back to the material supplier for reuse, either with or without the inner tank.

Some foldable IBCs have been seen where the base of the container is in the form of a pallet with the side and top walls provided in a loose manner for later assembly. One disadvantage of this type of IBC is that separate, loose components increase the likelihood that a component of one container might be lost, misused or mixed with the components of another container. Additionally, the time and effort required to assemble such a container is intensive and, accordingly, expensive.

Other foldable containers have been seen where the base, sidewalls and top wall are all connected together. This type of construction avoids the problems of losing individual components of a specific container. However, when folding these containers, a specific folding procedure, which is not always readily apparent from the appearance of the container, must be followed to ensure that the container will fold and its maximum size reduction is achieved. Additionally, because of these specific folding procedures, the actual dimensions of the container's sidewalls, as well as the base and the top wall, are often dictated by the construction itself. One often seen consequence of this is that, when folded, the walls do not lay parallel to the base. Rather, the walls lie in an inclined state which makes stacking of multiple folded containers difficult and potentially unsafe.

Another problem with IBCs in general relates to the filling of the inner tank. In a foldable IBC, the inner tank is often provided to the liquid supplier in a collapsed condition within the folded shell itself. When attempting to fill a collapsed container, difficulties arise in accessing the container and ensuring that all air contained therein is properly evacuated as the container fills and assumes its uncollapsed shape.

One way of trying to avoid the problems associated with filling a collapsed tank is to provide a bridge across the top of the erected outer shell and suspending the inner tank from the bridge so as to support the collapsed inner container during filling. Another method is to inflate the inner container with air prior to filling. As the inflated container is filled with the liquid, the air within the inner container is evacuated in a controlled manner.

Problems arise with both of the above systems because of the awkwardness with which the collapsed inner tank is accessed after the outer shell has been erected. The size of the IBC itself makes leaning over the sides of the outer shell, in order to grasp the inner container for inflation or connecting to the bridge, a difficult and strenuous procedure.

Yet another limitation of prior IBCs relates to the valve assembly generally used with these containers. Typically, these containers are provided with an integral discharge nipple or fitting which is obstructed by a web or wall that has been unitarily formed in the nipple during blow molding of the inner tank itself. Once a filled IBC is received by the end user, a valve assembly, provided separate from the IBC, is threaded onto the end of the nipple. This valve assembly is provided with an integral knife that will pierce the web obstructing the passageway. However, the web is not completely removed and a portion of it remains unitarily connected to the nipple to prevent it from occluding the outlet. Once attached, the valve assembly extends outward beyond the exterior of the IBC.

Obviously, an IBC could not be shipped with the valve extending beyond its side walls because of potential damage to the valve. An additional problem with this construction is that the end user must keep a supply of separate valve assemblies on hand for use with the IBCs. Another problem specifically relates to the piercing of the web and discharge nipple. As a result of the web not being completely removed from the interior of the discharge nipple, partial obstruction of the discharge passageway occurs and some amount of liquid will always remain therein impeding recycling of the inner tank.

In view of the foregoing limitations and shortcomings of the prior art devices, as well as other disadvantages not specifically mentioned above, it should be apparent that there still exists a need in the art for an improved foldable intermediate bulk container.

It is therefore a primary object of this invention to fulfill that need by providing a shipping container of the intermediate bulk container variety in which various components are connected to each other in a manner permitting folding into a flat, compact condition.

Another object of the present invention is to provide a foldable shipping container which, when folded, permits stacking in a stable manner and which compensates for any dimensional irregularities such that the folded container itself is provided with a compact, rectangular, generally box-like construction. A related object of this invention to provide a foldable shipping container which accommodates the differences in height of the side walls with respect to the length and width of the overall container so that, in its folded condition, none of the components of the IBC extend beyond the perimeter defined by its base.

Another object of this invention is to provide a mechanism which enhances the ability to fill the inner container of a shipping container.

It is also an object of this invention to provide an easily accessed pneumatically inflatable support structure within the inner tank of the shipping container which will increase the ease with which the inner tank can be filled and any air contained therein evacuated.

Another object of this invention is to provide a shipping container in which the end user is not required to install a valve assembly to the container at the site of use. A related object is to provide a shipping container in which the valve assembly is provided with the container and attached to the inner tank before shipment to the liquid supplier prior to filling of the inner container and shipping of the filled container to the end user.

Still another object of this invention is to provide a shipping container in which the valve assembly is protected during shipping and transporting of the container in either its folded or erected condition.

SUMMARY OF THE INVENTION

Briefly described, these and other objects are accomplished according to the present invention by providing a foldable shipping container which can be shipped in either a folded or erected condition, each maximizing transportation space. The shipping container is of the intermediate bulk container (IBC) variety and includes an outer container which is principally composed of a rectangular base, a front wall, a rear wall, a pair of side walls and a top wall. The various walls are interconnected with one another and cooperate to form a collapsible or foldable outer shell. When erected, the outer shell is box-like in shape. The walls cooperate with one another in a predetermined manner so that when folded, the container walls have a stacked construction whose height is substantially reduced from that of the erected container.

The base of the container includes a perimeter which is defined by upright sides between which generally extends a floor pan. The floor pan supports a molded, plastic resin inner tank that is adapted to store flowable materials. When erected, the various walls of the container are upright with respect to the base and located generally around the perimeter of the base. The perimeter of the top wall substantially corresponds to the perimeter of the base and forms a lid over the receiving cavity defined by the walls of the container.

The rear edge of the top wall is connected via a hinge to the top edge of the rear wall so that the top wall can be rotated about this edge to a position where the top wall generally extends vertically adjacent to the rear wall. Accordingly, the top wall is always attached to the remainder of the container. The front and rear walls are connected through a hinge along their vertical side edges to the side walls. The side walls themselves are constructed so that they are capable of folding inwardly about a medial axis and generally in half. As the side walls are folded, the front wall is caused to move toward the rear wall and finally stops when located in a position substantially adjacent to the rear wall, with the folded side walls located immediately therebetween. When collapsed into this position, the "stack" of walls is in a substantially upright orientation relative to the base.

The rear wall is further connected to the base to permit the collapsed stack of walls to be folded from their upright orientation, downward upon the base and into a generally horizontal orientation. The connection of the rear wall with the base is such that it enables the top wall to be centered relative to the base. In the preferred embodiment, the horizontally orientated stack of walls can be moved across the base to bring the perimeter of the top wall into registry with the perimeter of the base. In this position, no portion of the top, rear, front or side walls extends beyond the perimeter defined by the base. The folded IBC therefore has an extremely compact construction which provides a level platform upon which other folded IBCs can be stacked and shipped.

The container of the present invention can be provided from the original manufacturer to the material supplier with a collapsed inner tank located within the folded outer shell. Previously, an operator was required to lean over the sides of the erected shell in order to access the inner tank prior to filling. With the present invention, the need to lean over the side walls of an erected outer shell in order to access the inner tank, prior to filling, has been eliminated. This is because the inner tank of the present invention is provided with an inflatable support column whose valve stem is attached to the top wall of the outer container. When the outer shell is folded, the valve stem is "snaked" from the inner tank through the folded walls so that it is easily accessed both during and after unfolding of the outer shell. Once the sides have been erected, the valve stem is attached to the top wall in a location which allows an air hose to be connected to it thereby inflating the support column within the inner tank. Once inflated, the support column operates to regulate the introduction of materials into the inner tank while at the same time regulating the evacuation of air out of the inner tank.

The base of the outer container is also provided with a recessed cavity that is adapted to contain the discharge valve assembly of the inner tank. This valve assembly is provided on the inner tank so that it does not extend beyond the perimeter of the base. This construction prevents inadvertent damage to the valve assembly during shipping and storing of the IBC. It further eliminates the need for an end user to maintain a supply of separate valve assemblies at the site of use.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 6:
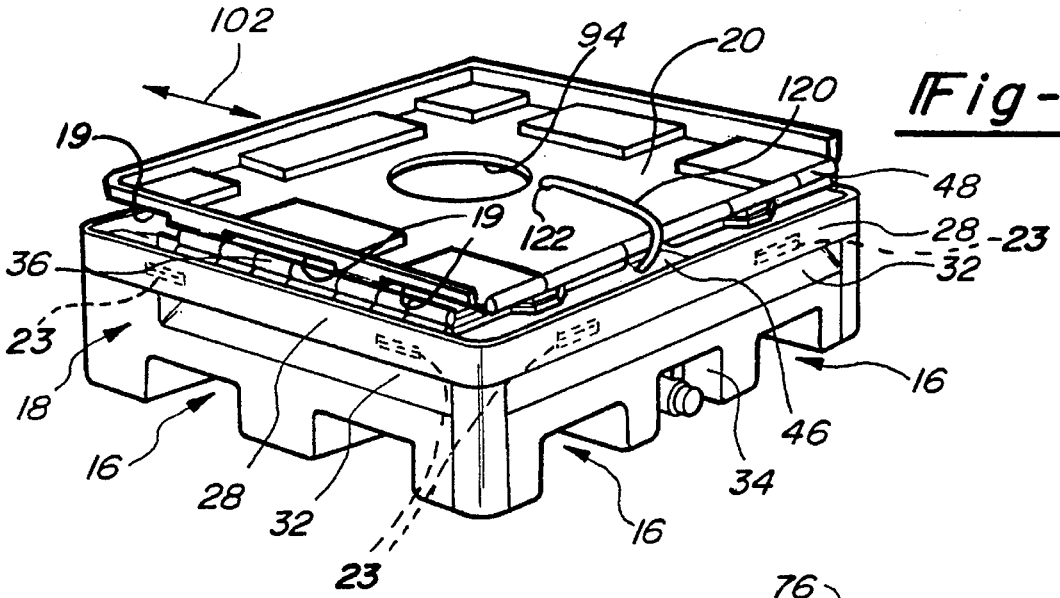
FIG. 6 is a perspective view of a shipping container embodying the principles of the present invention and located in its folded condition and ready for shipping.

Referring now in detail to the drawings, an intermediate bulk container (IBC) embodying the principles of the present invention, generally designated at 10, is shown in its fully erected condition. A fully folded container 10 is seen in FIG. 6. Principally, the shipping container 10 is comprised of a foldable outer container or shell 12 and a collapsible inner container or tank 14.

Figure 1:
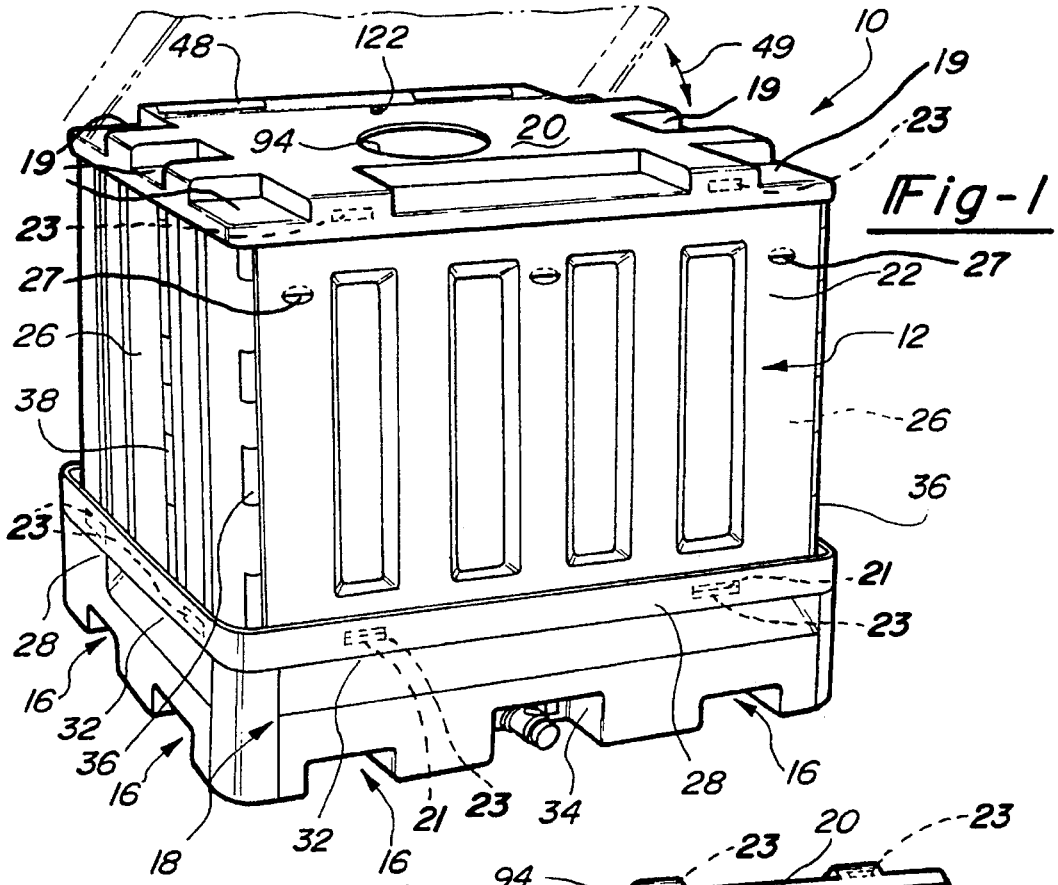
FIG. 1 is a perspective view of a shipping container embodying the principles of the present invention in which the outer container is fully erected.
Figure 2:
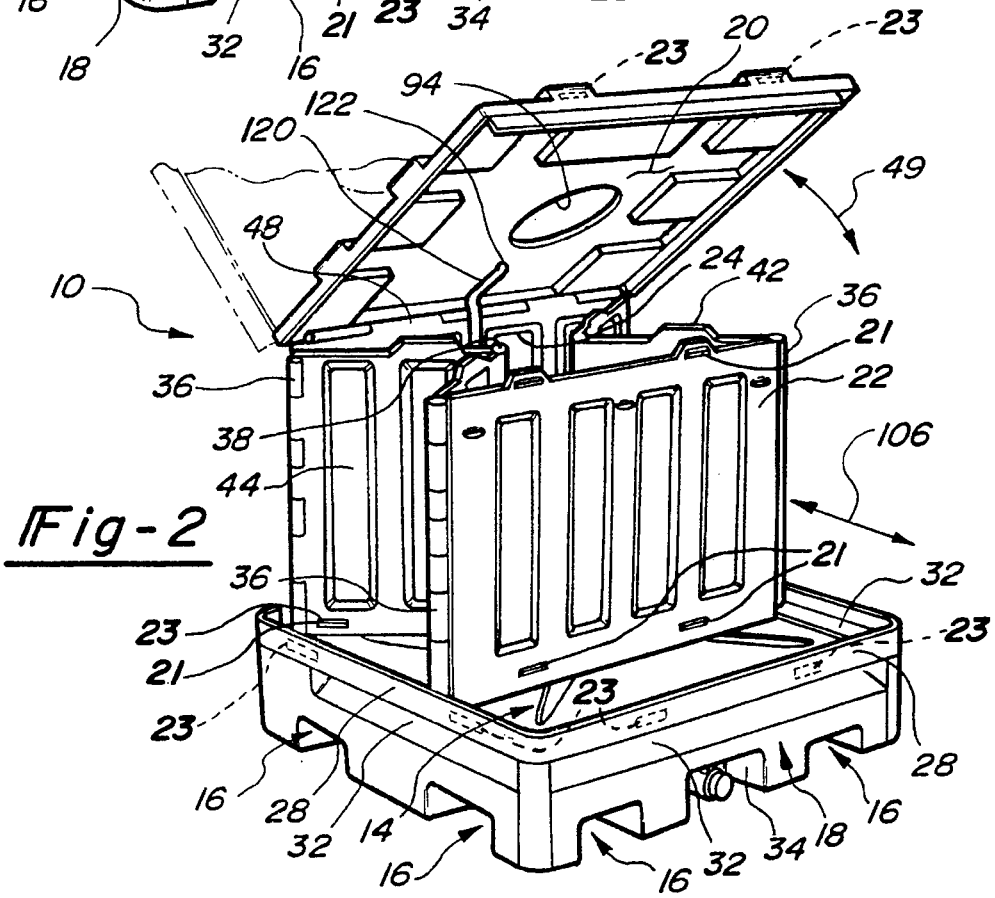
FIG. 2 is a perspective view of a shipping container embodying the principles of the present invention in which the top wall is being folded about the upper edge of the rear wall and the front wall is being moved causing the side walls of the outer container to fold in an inward direction.
Figure 3:
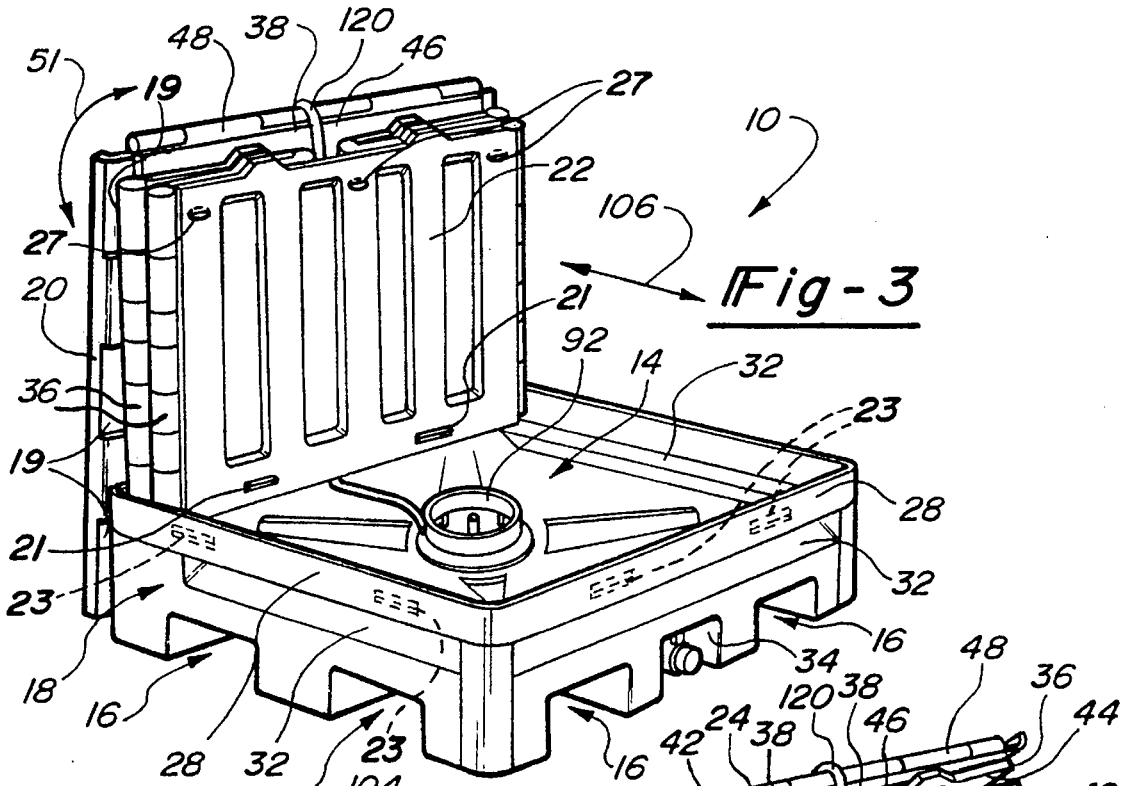
FIG. 3 is a perspective view of a shipping container embodying the principles of the present invention illustrating the various walls of the outer container all folded into a substantially vertical orientation.
Figure 4:
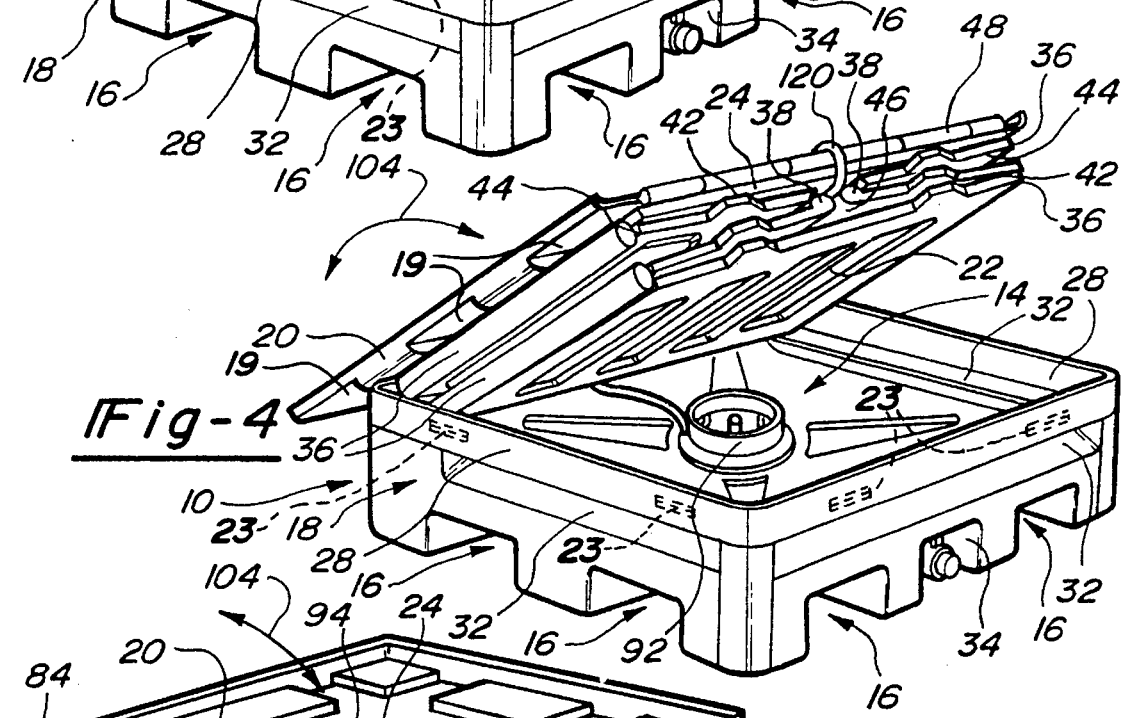
FIG. 4 is a perspective view of a shipping container embodying the principles of the present invention showing the rear wall pivoting about the lower edge so as to move the folded walls of the outer container from a generally vertical orientation into a substantially horizontal orientation.

The shipping container 10 of this invention is intended to allow for compact and economical shipping from the container manufacturer to the flowable material (hereinafter liquid) supplier and also for return shipping from the end user to the liquid supplier for reuse. As seen in FIG. 6, in its folded condition, the shipping container 10 is provided with an extremely compact and sturdy construction. Generally, this construction allows for the stacking of multiple folded containers 10 during transportation to the liquid supplier. Once received at the liquid supplier's facilities, the shipping container 10 is easily unfolded and erected into the condition seen in FIG. 1. The inner tank 14 can then be filled with a liquid and the filled container 10 shipped to the end user. In its erected condition, the shape of the shipping container 10 maximizes shipping space and also allows for the stacking of full containers 10 upon one another.

In both its folded and erected conditions, the shipping container 10 is easily handled during transportation and storage. To facilitate handling, spaced apart openings 16 are defined in the base 18 of the container 10. The openings 16 are located in the sides of the base 18 to enable the insertion of forklift tines beneath the base 18 from any side of the container 10.

The outer shell 12 of the shipping container 10 includes, in addition to the base 18, a substantially flat top wall 20 and a plurality of upright walls which are specifically identified as a front wall 22, a rear wall 24 and opposing side walls 26.

The base 18 itself is formed with upright sides 28 that cooperate to define the perimeter of the base 18. A floor pan 30 provides support for the inner tank 14 and is sloped toward the front of the container 10 while being recessed from the upper edge of the sides 28 and extending therebetween. Additionally, a shelf 32 is generally defined along the interior surface of the sides 28 of the base 18 to support the walls 22, 24 and 26 when the shipping container 10 is in its fully erected condition. Also, that side 28 of the base 18 which corresponds with the front wall 22 has a fitting cavity 34 generally centrally defined within it. The cavity 34 extends inward and upward and an access opening is defined in the floor pan 30 to correspond with the cavity 34. The purpose of the cavity 34 is further described below.

The shipping container 10 generally exhibits a cubic shape in its erected condition with the perimeter of the top wall 20 corresponding with the perimeter of the base 18. Because the walls 22, 24 and 26 are supported on the shelves 32 formed in the sides 28 of the base 18, it can be seen that the individual height of the walls 22, 24 and 26 is less than the overall height of the container 10 and the width of each wall 22, 24, and 26. Obviously, these dimensional differences have been taken into account in order for the container 10 to properly fold.

All of the walls 22, 24 and 26 are secured to one another through hinged connections. More specifically, the front wall 22 and rear wall 24, along their respective side edges, are connected to the side walls 26 by hinges 36 that generally extend the height of the respective side edges. The side walls 26 themselves are hinged at 38 along a vertical, medial axis through the center of the side walls 26. This provides the side walls 26 with a bi-fold construction that includes a front panel 42 and a rear panel 44. In each hinge 36 and 38, part of the hinge is formed by one wall or panel and an adjacent part of the hinge is formed by the other wall or panel. A pin (not shown) extends through the two parts of the hinge. The pin may be formed separate from both or integrally with one of the pads of the hinge. Obviously, numerous other types of hinge constructions can be used without affecting the operability of the present invention.

The hinged connection 38 in the middle of the side walls 26 is such that it allows the front and rear panels 42 and 44 to fold inwardly toward the center of the outer shell 12 in a manner similar to a bifold panel or door. As a consequence of the front and rear panels 42 and 44 being fold upon one another, the front wall 22 is laterally moved toward the rear wall 24. During this movement, the front wall 22 is supported on the shelves 32 mentioned previously. By continuing to move the front wall 22 toward the rear wall 24, the front and rear panels 42 and 44 of the side walls 26 will eventually completely fold upon themselves, at which point, the front wall 22 will be substantially adjacent to the rear wall 24 with the two folded side walls 26 located immediately between them. Since the width of each sidewall 26 is greater than its height, when folded these dimensional differences cause an open channel 46 to be generally defined between all of the collapsed walls 22, 24 and 26 as seen in FIGS. 2–5.

The top wall 20 itself is provided with a substantially flat surface so that any casual or excess fluid on top of the container 10 will be provided with easy run-off. Additionally, recesses 21 are formed in the top wall 20 so as to correspond with and receive the feet of another base 18 (as defined between the openings 16 and cavity 34 ) thereby readily permitting stacking of the containers 10.

The rear edge of the top wall 20 is attached to the upper edge of the rear wall 24 in a hinged connection 48. This allows the top wall 20 to pivot along arrows 49 and 51 from a position where it forms a lid across the top of the container 10 (as in FIG. 1) to a position where it extends substantially downward along the exterior surface of the rear wall 24. With the top wall 20 substantially adjacent to the rear wall 24, it is located so as to be generally parallel with not only the rear wall 24, but also the front wall 22 and side walls 26 which have been folded or collapsed upon one another. In this manner, all of the walls extend generally upward from the rear edge of the base 18 adjacent to and parallel with one another. With this construction, it is possible for the top wall 20 to always remain attached to the container 10.

Figure 5:
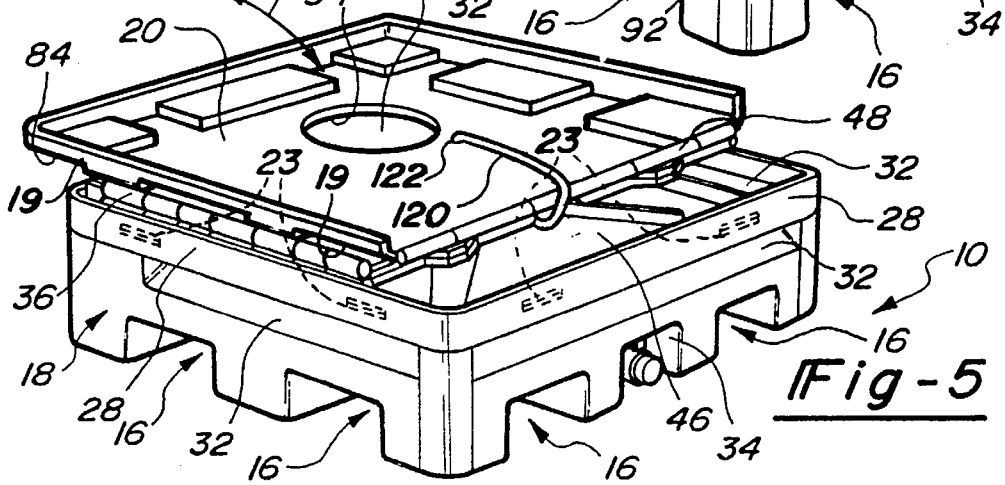
FIG. 5 is a perspective view of a shipping container illustrating the various walls of the outer container horizontally oriented and positioned where the top wall is not in registry with the perimeter of the base.
Figure 7:
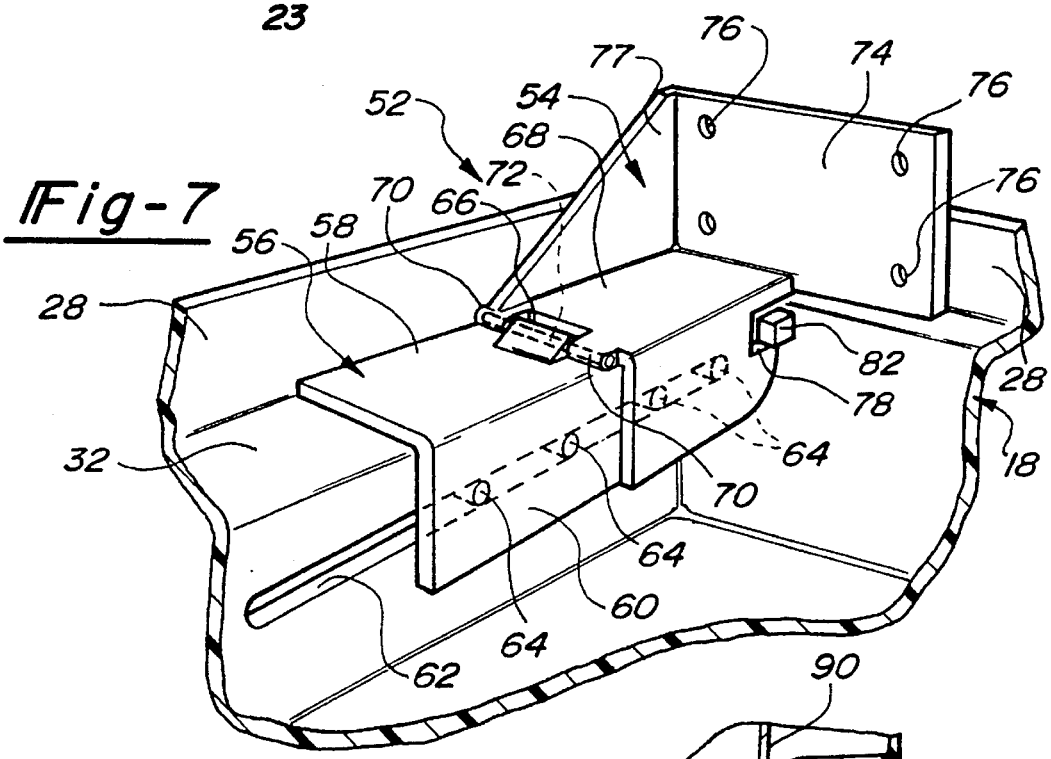
FIG. 7 is a perspective view of a portion of the present invention illustrating in greater detail the mechanism by which the rear wall is attached to the base of the container for pivoting and sliding movement.
Figure 9:
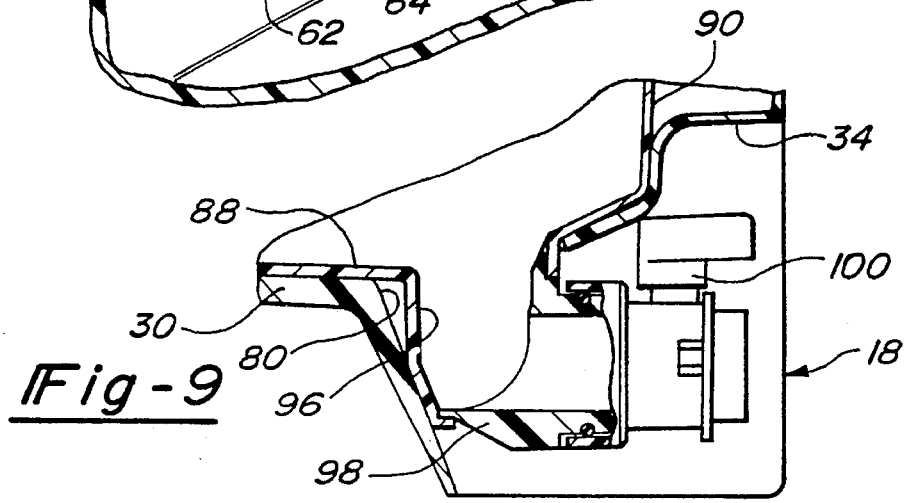
FIG. 9 is a sectional view illustrating the valve assembly of the inner tank in a recessed portion of the outer container.

From this upright position, the collapsed stack of walls 20, 22, 24 and 26 can be folded down, coming to rest on the shelves 32 and suspended above the floor pan 30. As seen in FIGS. 5 and 6, in this position the top wall 20 is located substantially horizontally forming a support surface upon which other folded containers 10 can be stacked. To accomplish folding in this manner, the lower edge of the rear wall 24 is pivotally connected to the rear edge of the base 18. One embodiment of the pivotal connection is seen in FIG. 7.

The pivotal connection includes a pair of hinged brackets 52, only one of which is shown for clarity. Each bracket 52 has a pivoting portion 54 and a sliding portion 56. The sliding portion 56 is illustrated as being an angled element which rests on the shelves 32. The sliding portion 56 is also secured to the shelf 32 for sliding movement relative thereto. While numerous constructions can be envisioned to provide for this relative sliding movement, in the illustrated embodiment the sliding portion 56 is provided as an angle section having an upper leg 58 which extends along the top of the shelf 32 and a downward leg 60 which extends downward along the side of the shelf 32. Extending outward from the downward leg 60 and into a slot 62 formed in the side of the shelf 32 are one or more bearings 64. The bearings 64 are illustrated as pins. Obviously, the bearings 64 could be provided as one of the many varieties of roller bearings or other type of bearings which would permit axial sliding of the slide portion 56 relative to the shelf 32.

The pivoting portion 54 includes a first member 68 which corresponds generally in shape with the sliding portion 56 so as to overlay a portion thereof. The first member 68 is formed such that a mounting boss 66 on the sliding portion 56 is received between a pair of lugs 70. The lugs 70 cooperate with the boss 66 to pivotally secure the pivoting portion 54 to the sliding portion 56. Accordingly, a pin 72, provided through one lug 70, the boss 66 and the remaining lug 70, provides the pivotal connection. So long as the pivotal relationship between the pivoting portion 54 and the sliding portion 56 is provided, the specific pivotal connection between those two portions 54 and 56 can vary from that as illustrated.

The pivoting portion 54 also includes a second member 74 which is integrally formed with the first member and extends in a generally upright fashion from the rear thereof. Being oriented in this upright fashion, the second member 74 is secured to the rear wall 24 of the outer shell. Accordingly, the second member 74 is provided with apertures 76 that receive screws, bolts or other fasteners that positively secure the second member 74 to the rear wall 24. To further rigidify the second member 74 relative to the first member 68, a rigidifying brace 77 can be provided between the two members 68 and 74.

To prevent the pivoting portion 54 from inadvertently rotating relative to the sliding portion 56, the hinged bracket 52 is provided with a locking feature. More specifically, the portion of the first member 68 which corresponds to the downward leg 60 of the sliding portion 56 includes a cut-out 78 at its rearward end. The cut-out 78 is located to receive an embossment 82 formed on the side of the shelf 32 and toward the rear of the base 18. When the hinged brackets 52 are slid completely to the rear of the base 18, as when the outer shell 12 is in its fully erected condition, the pivoting portion 54 is prevented from rotating relative to the sliding portion 56 because the embossment 82 interferingly engages the cut-out section 78.

As mentioned above, after being rotated downward about the pivotal connection 50, the collapsed stack of walls 20, 22, 24 and 26 rests on the shelves 32 of the sides 28 of the base 18. Once in this folded, horizontal position, it can be seen that the top wall extends a distance beyond the rear edge of the base 18 in an overhang 84. This is because the height of the front, rear and side walls 22, 24 and 26 is less than the overall height of the container 10 and less than the length of the top wall 20.

Dimensional differences, which are found to one degree or another in most, if not all, foldable shipping containers 10, present these types of problems in that they do not permit compact folding of the outer shell 12 unless fully taken into consideration in designing the container. For example, often the top wall will not lay flat and provide a suitable surface upon which another container can be stacked. Also, is has been seen where one portion of the folded container extends beyond the remaining portions in an overhang which prevents placement of another folded container immediately adjacent to it. Obviously, the above examples are illustrative of an inefficient use of shipping space when the folded containers 10 are being transported.

To eliminate the overhang 84 of the top wall 20 in the present invention, the hinged bracket 52 between the rear wall 24 and the rear edge of the base 18 is provided with the sliding portion 54. Once folded into its horizontal position, the top, front, rear and side walls 20, 22, 24 and 26 can be slid toward the front end of the base 18 by causing the sliding portion 54 to slide along the shelf 32 on the bearing 64. The length of the slot 62 is such that movement is limited to the extent that the perimeter of the top wall 20 is brought into registry or conformity with the perimeter of the base 18 thus providing the folded container 10 with its compact construction.

Figure 8:
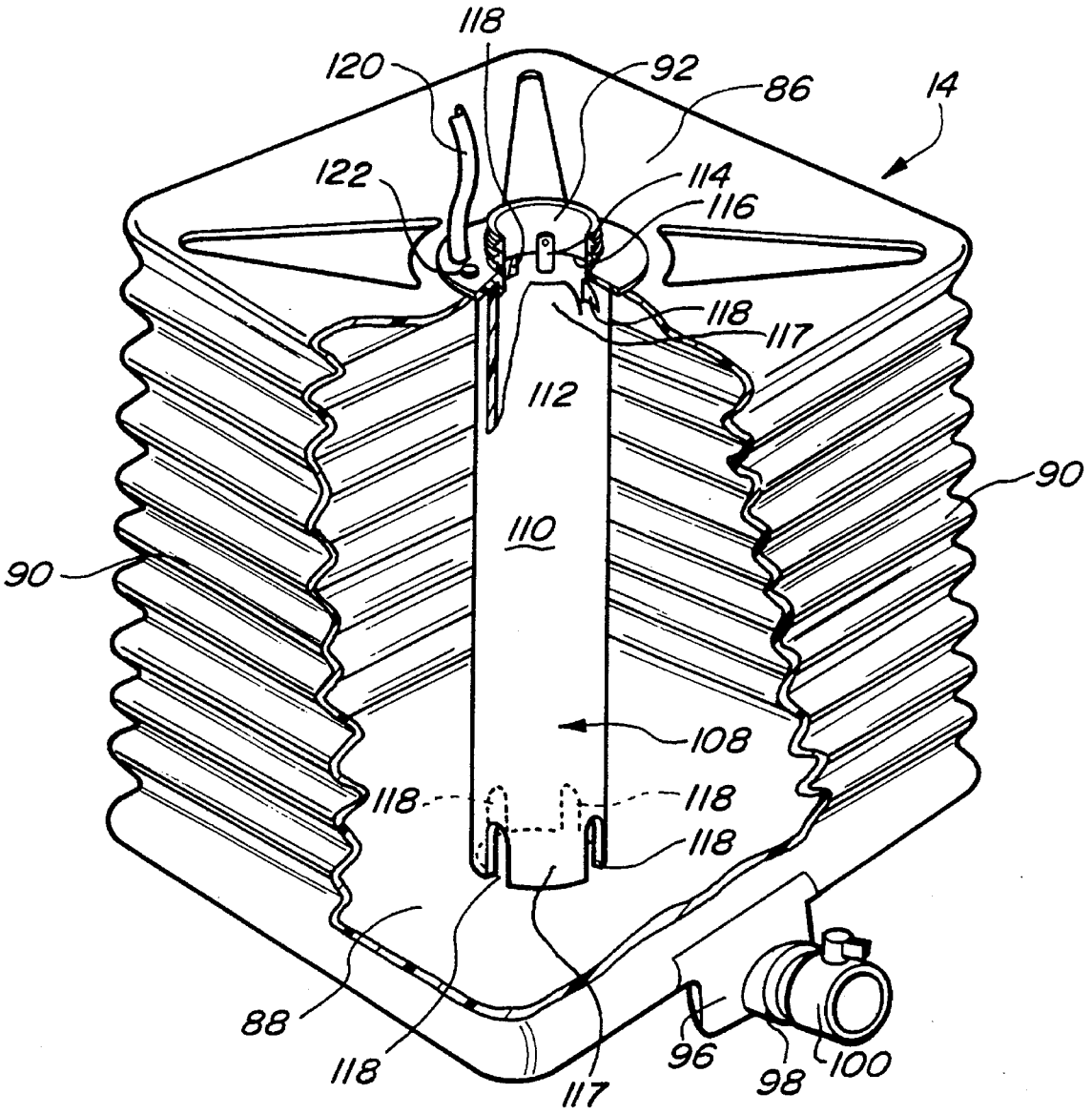
FIG. 8 is a perspective view with portions broken away illustrating an inner tank as utilized with a shipping container embodying the principles of the present invention.

The present invention is designed so that when sent from the container manufacturer to a liquid supplier, the inner tank 14 may be incorporated into the folded construction of the outer shell 12. This is accomplished by providing a molded plastic resin inner tank 14 having a collapsible construction. One example of such a tank 14 is illustrated in FIG. 8.

The tank 14 includes a top wall 86, a bottom wall 88 and side walls 90. The top wall 86 is provided with a fill port 92 which corresponds with a fill aperture 94 defined in the top wall 20 of the outer shell 12. The bottom wall 88 of the inner tank 14 is provided with a lower housing 96 that includes a discharge nipple 98. The housing and discharge nipple 98 extend below the bottom wall 88, as well as below the floor pan 30 and through an opening 80 into the cavity 34 of the base 18. Additionally, a discharge valve assembly 100 is secured to the end of the discharge nipple 98 such that the valve assembly 100 is also located within the receiving cavity 34 and does not extend beyond the perimeter of the base 18. In this manner, the valve assembly 100 can be provided to the liquid supplier and end user without fear that the valve assembly 100 will be damaged during transportation.

The side walls 90 of the inner tank 14 are corrugated in an accordion-like construction which enables the side walls 90 of an empty inner tank 14 to collapse and bring the top wall 86 down on top of the bottom wall 88. This provides the inner tank 14 with a reduced height construction allowing the collapsed inner tank 14 to rest on the floor pan 30 even when the outer shell 12 is folded. Generally, the collapsed inner tank 14 will be located between the floor pan 30 and the folded down position of the front wall 22.

At the liquid supplier's facilities, the folded shipping container 10 is erected by sliding the folded stack of collapsed walls 20, 22, 24 and 26 in the direction of arrow 102 (see FIG. 6), raising the horizontally oriented stack of walls 20–26 in the direction of arrow 104 (see FIG. 4), laterally moving the front wall 22 in the direction of arrow 106 (see FIG. 2) toward the front edge of the base 18 causing the front and rear panels 42 and 44 to unfold and form the planar side walls 26 of the outer shell 12. The top wall 20 is then pivoted as indicated by arrow 49 and 51 (see FIG. 2) about the hinge connection 48 from its open position where it is substantially adjacent to rear wall 24 to its closed position where it forms the lid of the outer shell 12.

In order to secure the front, back and sidewalls 22, 24 and 26 to the base 18 and top wall 20 when erected, these walls 22, 24 and 26 are provided with latching protuberances 21 along their bottom and top edges. The protuberances 21 are positioned so that they will be received within slots 23 correspondingly positioned along the interior edges of the base 18 and the top wall 20. It should be noted that the protuberances 21 on the panels of the side walls 26 are vertically offset from one another and positioned adjacent to slots 25 also formed in the panels themselves. This construction ensures that the panels can be folded flat upon one another by allowing the protuberance 21 of one panel to be received within the slot 25 of the other. It should also be noted that prior to fully unfolding the front, back and side walls 22, 24 and 26 of the container 10, the top wall 20 is lowered down onto the upper perimeter of the walls 22, 24 and 26. The front wall 22 is then moved into its fully extended position and its protuberances 21 are brought into their corresponding slots. Otherwise, the protuberances of the front wall 22 would interfere with the complete closing or lowering of the top wall 20. To assist in fully extending the front wall 22 with the top wall 20 lowered, recessed hand grips 27 are formed in the front wall 22.

Because of the many difficulties associated with the filling a collapsed inner tank 14, the tank 14 of the present invention is provided with an inflatable internal support structure 108. When inflated, the internal support 108 raises the fill port 92 of the inner tank 14 up to the fill aperture 94 where it can be easily accessed. The internal support 108 includes an inflatable bladder 110 which is generally cylindrical in shape and which defines a fill passageway 112 through its middle. The upper end of the bladder 110 is secured to the fill port 92 by being overfit onto four clips 114 which themselves are mounted to a flange 116 of the port 92 by conventional methods, such as plastic welding. The clips 114 frictionally retain the internal support 108 by engaging the interior surface of the support 108 which defines the passageway 112. If desired, the support 108 can be permanently secured to the clips 114. The lower end of the bladder 110 is provided so that it freely contacts the interior of the bottom wall 88.

The bladder 110 is provided with castellations 117 and openings 118 at both its upper and lower ends. Depending on whether the inner tank 14 is being filled or emptied, the openings 118 between the castellations 117 at the bottom allow the liquid to freely flow out of or into the passageway 112 within the bladder 110. The openings 118 and castellations 117 on the upper end of the bladder 110 operate to either exhaust air out of the tank 14 through the fill port 92 or permit air to be entrained into the interior when liquid is being emptied from the inner tank 14. While four equidistantly spaced castellations 117 and openings 118 are shown on both the top and bottom of the bladder 110, more or less castellations 117 and openings 118, as well as non-equal spacing, could be employed.

To permit inflation of the internal support 108, an air line 120 extends from the upper end of the bladder 110 to a valve 122 mounted on the top wall 20. The air valve 122 introduces air from a compressed air source through the air line 120 into the inflatable bladder 110 causing it to inflate. When the inner tank 14 is collapsed and the outer shell 12 folded, the air line 120 is snaked from the top wall 86 of the inner tank 14 generally toward the rear of the base 18. At the rear of the base 18, the air line 120 is returnly bent and fed through the channel 46 between the collapsed stack of walls until exiting at the opposite end of the channel 46 adjacent to the upper edges of the walls 22, 24 and 26. The air line 120 is then returnly bent back over the top wall 20, along the outwardly facing interior surface of the top wall 20, and secured in some fashion or attached to the valve 122. Alternatively, the air line 120 can be secured within the channel 46 to prevent any potential damage to the air line 120 itself. In that situation, the air line 120 is provided with a sufficient length that will allow it to be connected to the air valve 122 after the outer shell 12 has been erected.

Adjacent to the air line 120, the bladder 112 is provided with a pressure relative valve 122 to assure against over-pressurization and permit easy deflection of the support column 110. The relief valve 122 also allows the column 110 to be filled without concern about over-pressurization which might result because of the bladder 112 being folded or creased while collapsed.

While the above description constitutes the preferred embodiment of the present invention, it will be appreciated that the invention is susceptible to modification, variation and change without departing from the proper scope and fair meaning of the accompanying claims.

We claim:

1. A foldable shipping container capable of being shipped in either a folded or erected condition, said container comprising a rectangular base, a front wall, a rear wall, a pair of side walls, and a top wall which cooperate to form a box-like outer shell when in said erected condition, said base having a perimeter defined by upright sides and including a floor pan extending generally between said sides, said top wall having a perimeter generally corresponding to said perimeter of said base, said top, rear, front and side walls being interconnected with one another to permit folding said top, rear, front and side walls into a substantially upright collapsed condition, one of said top, rear, front and side walls being pivotally mounted to said base by a pivoting means for pivoting movement of said top, rear front and side walls from said substantially upright collapsed condition to a substantially horizontal collapsed condition where said top, rear, front and side walls are generally horizontally oriented and resting on said base, said one of said top, rear front and side walls also being slidably mounted to said base by a sliding means for sliding movement of said top, rear, front and side walls while in one of said collapsed conditions thereby moving said walls in said collapsed condition relative to said base and said perimeter of said top wall at least in registry with said perimeter of said base.

2. A foldable shipping container as set forth in claim 1 further comprising a collapsible inner tank adapted to store flowable materials therein, said inner tank being supported by said floor pan and received between said front, rear and side walls.

3. A foldable shipping container as set forth in claim 2 wherein said inner tank is removable from between said front, rear and side walls.

4. A foldable shipping container as set forth in claim 1 wherein said front and rear walls are hingedly interconnected with said side walls along side edges thereof.

5. A foldable shipping container as set forth in claim 4 wherein said side walls are capable of folding generally in half along a medial axis therethrough.

6. A foldable shipping container as set forth in claim 5 wherein folding of said side walls induces translational movement of said front wall toward said rear wall until said front and rear walls are substantially adjacent to each other with said side walls located immediately therebetween in a folded condition.

7. A foldable shipping container as set forth in claim 1 wherein said pivoting means is pivotally connected to said sliding means.

8. A foldable shipping container as set forth in claim 1 wherein said rear wall is pivotally connected to said base by said pivoting means.

9. A foldable shipping container as set forth in claim 1 further comprising lock out means for preventing pivoting of said walls from said upright collapsed condition to said horizontal collapsed condition when said walls are not in said upright collapsed condition.

10. A foldable shipping container as set forth in claim 9 wherein said lock out includes a boss which interferingly engages said pivoting means.

11. A foldable shipping container as set forth in claim 10 wherein said lockout is disengaged upon sliding movement of said walls by said sliding means.

12. A foldable shipping container as set forth in claim 1 wherein said sliding means is capable of sliding movement while said walls are in said upright collapsed condition.

13. A foldable shipping container as set forth in claim 1 further comprising a collapsible inner tank adapted to be located within said container when said container is in said folded condition.

14. A foldable shipping container as set forth in claim 13 wherein said inner tank includes inflating means for inflating said inner tank with air, said inflating means including an air line extending from said inner tank and between said front, rear and side walls in said collapsed condition.

15. A foldable shipping container as set forth in claim 14 wherein said air line is extended within an open channel defined between said front, rear and side walls in said collapsed condition.

16. A foldable shipping container as set forth in claim 1 further comprising latching means for retainably engaging said front, rear and side walls with said top wall and said base when in said erected condition.

17. A foldable shipping container as set forth in claim 16 wherein said latching means includes protuberances and slots formed on said walls and said base.

18. A shipping container comprising an outer container enclosing an inner tank, said outer container including a base, side walls, and a top wall, said base having upright walls defining a perimeter of said base, a floor pan extending between said upright walls for supporting said inner tank thereon, portions of said floor pan defining an opening therethrough generally adjacent to one side edge of said base, a cavity defined by portions of said base generally below said floor pan and accessible through said opening, portions of one of said walls of said base defining a lateral opening into said cavity, said inner tank constructed out of a molded plastic resin and being adapted to store flowable materials therein, said inner tank including a bottom wall, a top wall and side walls, a discharge housing connected to said bottom wall generally adjacent to one of said side walls and extending downward therefrom, said discharge housing being in communication with the interior of said inner tank and including a nipple having a valve assembly mounted thereto for permitting discharging of the flowable materials from said container, said discharge housing being received in said cavity such that said valve assembly is wholly enclosed within said perimeter of said base.

19. A shipping container as set forth in claim 18 wherein said outer container is foldable.

20. A shipping container as set forth in claim 18 wherein said inner tank is removable from said outer container.

21. A shipping container comprising an outer container enclosing an inner tank, said outer container including a base, side walls, and a top wall, said base having upright walls defining a perimeter and a floor pan extending between said upright walls for supporting said inner tank thereon, said inner tank being adapted to store flowable materials therein, said inner tank being incapable of supporting itself when empty and including a bottom wall, a top wall, side walls, a discharge port and a fill port located in said top wall, support means located within said inner tank for supporting said top wall of said inner tank above said bottom wall of said inner tank during filling of said inner tank, said top wall of said inner tank being supported by said support means a distance above said bottom wall generally corresponding to the height of said inner tank and thereby readily permitting filling of said inner tank.

22. A shipping container as set forth in claim 21 wherein said support means includes an inflatable bladder.

23. A shipping container as set forth in claim 22 wherein said bladder is generally tubular having a passageway defined therethrough, said passageway being in registry with said fill port of said inner tank.

24. A shipping container as set forth in claim 23 wherein said passageway through said support means is in communication with the interior of said inner tank.

25. A shipping container as set forth in claim 24 wherein said bladder includes portions defining openings permitting communicating between said passageway and the interior of said inner tank.

26. A shipping container as set forth in claim 25 wherein said opening are generally defined at upper and lower ends of said support means.

27. A shipping container as set forth in claim 21 wherein said support means is secured to said fill port.

28. A shipping container as set forth in claim 21 wherein said support means is frictional secured to said fill port.

29. A shipping container as set forth in claim 21 wherein said inflatable bladder includes valve means for use in inflating said inflatable bladder, said valve means being located exteriorly of said inner tank.

30. A shipping container as set forth in claim 21 wherein said valve is secured to said outer container.

31. A shipping container as set forth in claim 21 wherein said inflatable bladder includes a pressure relief valve means for preventing over pressurization of said inflatable bladder.

32. A foldable shipping container capable of being shipped in either a folded or erected condition, said container comprising an outer shell and an inner tank, said outer shell having a rectangular base, a front wall, a rear wall, a pair of side walls, and a top wall which cooperate to form a box-like outer shell when in said erected condition, said base having a perimeter defined by upright sides and including a floor pan extending generally between said sides for supporting said inner tank thereon, portions of said floor pan defining an opening therethrough generally adjacent to one side of said base, a cavity defined by portions of said base generally below said floor pan and accessible through said opening, portions of one of said side of said base also defining a lateral opening into said cavity, said top wall having a perimeter generally corresponding to said perimeter of said base and being connected to said rear wall along a top edge of said rear wall for pivotal movement from a position where said top wall forms a lid over said shipping container to a position where said top wall is generally in a side-by-side location with said rear wall, said front, rear and side walls being hingedly interconnected with one another to permit folding said front, side and rear walls into an upright collapsed condition where said front wall is substantially adjacent to said rear wall and said side walls are located immediately therebetween, said rear wall being connect to said base by pivoting means for folding of said front, side and rear walls while in said collapsed condition downward upon said base into a generally horizontal collapsed condition, said rear wall also being connected to said base to permit sliding movement of said front, side and rear walls while in said collapsed condition so as to permit said perimeter of said top wall to be brought generally into registry with said perimeter of said base, said inner tank adapted to store liquids therein being positionable within said container when said container is folded or erected, said inner tank including a top wall, side walls, a bottom wall, a fill port located in said top wall and an inflatable support means secured to said fill port and located within said inner tank for supporting said top wall of said inner tank above said bottom wall of said inner tank during filling of said inner tank, said top wall being supported by said support means a distance generally corresponding to the height of said inner tank, a discharge housing connected to said bottom wall generally adjacent to one of said side walls of said inner tank, said housing extending downward therefrom and including a nipple having a valve assembly mounted thereto, said discharge housing being received in said cavity in said base such that said valve assembly is wholly enclosed within said perimeter of said base.

* * * * *